United States Patent [19]

Menrad et al.

[11] 3,971,632

[45] July 27, 1976

[54] SINTERED ABRASION RESISTANT IRON ALLOY HAVING A HOMOGENEOUS CARBIDE NETWORK

[75] Inventors: Berthold Menrad, Weiler i.d.B.; Karl Ripper, Schwabisch Gmund; Rudolf Ilg, Hofen; Georg Dietrich, Schwabisch Gmund, all of Germany

[73] Assignee: Zahnradfabrik Friedrichshafen AG, Friedrichshafen, Germany

[22] Filed: Oct. 16, 1973

[21] Appl. No.: 406,834

[30] Foreign Application Priority Data

Oct. 20, 1972 Germany ..... 2251535

[52] U.S. Cl. ..... 29/182.7; 29/182.5; 29/182.8

[51] Int. Cl.[2] ..... C22C 1/05

[58] Field of Search ..... 29/182, 182.5, 182.7, 29/182.8; 75/214, 224

[56] References Cited

FOREIGN PATENTS OR APPLICATIONS 975,322 11/1964 United Kingdom

OTHER PUBLICATIONS

Chem. Abs., No. 62; 3738g, 1965 [British Pat. 975,322, 11/18/64, Marshall et al.].

*Primary Examiner*—Richard E. Schafer

[57] ABSTRACT

A particular composition and method are given for an iron alloy which will produce an article by sintering which is highly resistant to abrasion as well as possessing high tensile strength. The alloy is particularly useful for bearings, either rotary or planar. Conditions of sintering are described to produce articles from a novel sintering powder having a homogenous carbide network in a lamellated, perlitic base structure with interspersed residual austenite and martensite to considerably improve the abrasion resistance.

1 Claim, No Drawings

SINTERED ABRASION RESISTANT IRON ALLOY HAVING A HOMOGENEOUS CARBIDE NETWORK

It has heretofore been known to produce sintered iron alloy articles of high tensile strength utilizing a formulary, by weight as follows:

| | |
|---|---|
| 0% – 6% | nickel |
| 0% – 4% | manganese |
| 0% – 1.5% | carbon in the form of graphite |
| 0.5% – 5% | copper |
| 0.01% – 0.4% | boron |

The remainder of the alloy is essentially iron with customary impurities, reference being made herein to the German published application No. 1,213,624.

More specifically, a preferred composition of the sintering powder consists of, by weight:

2.4% nickel
1% copper
1.6% manganese
0.8% graphitic carbon
0.2% copper borate

The remainder being essentially iron with customary impurities.

The above composition produces a high tensile strength sintered iron alloy but not exceptional in abrasion resistance required for bearing surfaces.

The invention herein is a discovery that changing said composition produces a high abrasion resistance for a sintering powder composition.

The new composition, by weight percentage is as follows:

| | |
|---|---|
| 1.4% – 1.7% | nickel |
| 1% | copper |
| 2% – 2.4% | manganese |
| 1% – 1.35% | graphite carbon |

-continued

| | |
|---|---|
| 0.2% | copper borate |

The remainder is essentially iron with customary impurities.

The preceding novel composition powder can be sintered into products such as raw materials for machine working or into articles, which have a uniform carbide network in a lamellated, perlitic base structure with interspersed residual austenite and martensite and such material or articles have a considerably enhanced resistance to abrasion as compared with those made of previously known compositions. It is believed that the carbon weight range of 1% to 1.35% in the composition effects the improvement. A higher carbon content could produce machining difficulties.

Insofar as the use of the novel sintering powder is concerned in a sintering process, it has been found that compression of the powder mixtures to 6.75 grams per cubic centimeter during sintering at a temperature of 1120° C for 25 minutes in an atmosphere of dissociated ammonia, enriched with propane produces the desired product. However, a metallic stearate is used as a lubricant during pelleting, in a furnace atmosphere regulated so that all combustion products of the lubricant decompose during the sintering and together with the composition of the atmosphere ensure minimum carbon decomposition in the alloy.

We claim:

1. An abrasion resistant sintered iron alloy having a homogenous carbide network in a lamellated, perlitic base structure with interspersed residual austenite and martensite with a composition

| | |
|---|---|
| 1% – 1.35% | graphitic carbon |
| 2% – 2.4% | manganese |
| 1.4% – 1.7% | nickel |
| 1% | copper |
| 0.2% | copper borate |

the remainder being essentially iron.

* * * * *